US005643625A

United States Patent [19]

Perry et al.

[11] Patent Number: 5,643,625

[45] Date of Patent: Jul. 1, 1997

[54] METHOD FOR PACKAGING REFRIGERATABLE YEAST LEAVENED DOUGHS

[75] Inventors: Michael R. Perry, Plymouth; Victor T. Huang, Moundsview; Diane R. Rosenwald, Shoreview; Andrew H. Johnson, Coon Rapids; Katy Ghiasi, Minneapolis, all of Minn.

[73] Assignee: The Pillsbury Company, Minneapolis, Minn.

[21] Appl. No.: 683,071

[22] Filed: Jul. 16, 1996

Related U.S. Application Data

[63] Continuation of Ser. No. 483,401, Jun. 7, 1995, Pat. No. 5,547,694, which is a continuation of Ser. No. 035,469, Mar. 23, 1993, abandoned.

[51] Int. Cl.[6] ..... B65D 81/20; A21D 10/02

[52] U.S. Cl. ..... 426/395; 426/396; 426/419; 426/415; 426/8; 53/432; 53/433

[58] Field of Search ..... 426/118, 128, 426/395, 415, 418, 419, 316, 8, 130, 396; 220/203.29, 371, 89.1, 203.02, 203.11, 203.15, 367.1, 373; 229/120; 53/432, 433

[56] References Cited

U.S. PATENT DOCUMENTS

| | | |
|---|---|---|
| 1,857,015 | 5/1932 | Gere . |
| 1,904,741 | 4/1933 | Corber . |
| 2,986,319 | 5/1961 | Bierman et al. . |
| 3,450,543 | 6/1969 | Badran et al. . |
| 3,450,544 | 6/1969 | Badran et al. . |
| 3,795,749 | 3/1974 | Cummin et al. . |
| 3,798,333 | 3/1974 | Cummin et al. . |
| 3,804,961 | 4/1974 | Cummin et al. . |
| 3,840,680 | 10/1974 | Cummin et al. . |
| 4,206,870 | 6/1980 | Devries . |
| 4,415,598 | 11/1983 | Chen et al. . |
| 4,423,080 | 12/1983 | Bedrosian et al. . |
| 4,426,401 | 1/1984 | Ottow et al. . |
| 4,444,219 | 4/1984 | Hollenstein . |
| 4,461,420 | 7/1984 | Horvath . |
| 4,590,078 | 5/1986 | Vmina . |
| 4,716,739 | 1/1988 | Harris . |
| 4,741,907 | 5/1988 | Furuhasi . |
| 4,830,863 | 5/1989 | Jones . |
| 4,842,875 | 6/1989 | Anderson . |

(List continued on next page.)

FOREIGN PATENT DOCUMENTS

| | | |
|---|---|---|
| 15574 | 8/1952 | Australia . |
| 0261929 | 3/1988 | European Pat. Off. . |
| 2533806 | 4/1984 | France . |
| 2609930 | 7/1988 | France . |
| 58-134980 | 11/1983 | Japan . |
| 59-31680 | 2/1984 | Japan . |
| 353840 | 3/1991 | Japan . |

OTHER PUBLICATIONS

Modern Packaging, pp. 169–172, 254 Oct. 1966.

Packaging, Robert Bosch Corp., No Date On Document.

Packaging, Borden Packaging and Industrial Products, "Resinite Produce Films", No Date On Document.

Sig Swiss Industrial Co., "Valve Packages for Coffee: Application Possibilities" & Aroma Fresh Packages, No Date On Document.

Food Engineering (Oct./1989), p. 68, "Permeability Matches Resiration in... Cap Produce".

Food Engeering (Jan/1989), p. 34, "New Packaging System Introduced"(Hercules, Inc.)

Abstract of 1990 Patent Publication By Hercules, Inc. Obtained from Computer Database (Rd 3/6020 Aug./10/1990).

*Primary Examiner*—Steven Weinstein

*Attorney, Agent, or Firm*—Edward S. Hotchkiss; Aleya Rahman

[57] ABSTRACT

Refrigerated dough packaging method includes packaging the dough in a package having a pressure release valve associated with a flange to substantially prevent the expanding dough from interfering with the gas venting abilities of the package.

6 Claims, 1 Drawing Sheet

U.S. PATENT DOCUMENTS 4,879,078 11/1989 Antoon .
4,883,674 11/1989 Fan .
4,890,637 1/1990 Lamparter .
4,923,650 5/1990 Antoon, Jr. et al. .
4,943,440 7/1990 Armstrong .
5,011,698 4/1991 Antoon, Jr. et al. .
5,019,410 5/1991 Pors et al. .
5,045,331 9/1991 Antoon, Jr. .
5,084,284 1/1992 Medila et al. .
5,160,768 11/1992 Antoon .
5,254,354 10/1993 Stewart .
5,307,985 5/1994 Belzermann .

METHOD FOR PACKAGING REFRIGERATABLE YEAST LEAVENED DOUGHS

This application is a continuation of application Ser. No. 08/438,401, filed Jun. 7, 1995, now U.S. Pat. No. 5,547,694, which is a continuation of application Ser. No. 08/035,469, filed Mar. 23, 1993, now abandoned.

FIELD OF THE INVENTION

The present invention relates to containers useful in packaging bread doughs and the like; containers of the invention are particularly well suited for packaging yeast-leavened bread doughs for extended storage at refrigeration temperatures.

BACKGROUND OF THE INVENTION

A wide variety of refrigeratable bread doughs are sold commercially. These doughs most commonly utilize chemical leavening agents, which generally comprise a combination of a leavening acid (e.g., citric acid, phosphate salts or glucono delta lactone (GDL)) and a leavening base (e.g., bicarbonate of soda). These acidic and basic components react with one another to generate carbon dioxide to "proof" the dough. In this proofing process, the chemical leavering agent generates a sufficient quantity of carbon dioxide to cause the dough to rise within the container. By using known quantifies of the components of the leavening agent, the total volume of carbon dioxide generated can be carefully controlled.

It is widely recognized that yeast-leavened doughs are superior to chemically leavened doughs, though. In particular, yeast-leavened doughs generally exhibit better taste, aroma and texture than do chemically leavened doughs. The yeast and the by-products of its fermentation in the proofing or leavening process tend to give the dough a more "home-baked" flavor and aroma than commercially produced doughs using chemical leavening agents.

Yeast is often used in producing frozen bread doughs. In commercially manufacturing these doughs, a large batch of dough is generally made and divided into smaller portions, which may be individually packaged and frozen for ultimate sale to consumers. Freezing the dough halts the fermentation activity of the yeast, preventing the yeast from leavening the dough. When the consumer desires to bake the frozen bread dough, the bread dough is thawed and must be allowed to stand at room temperature so the yeast may leaven the dough before the dough may be baked. Although such frozen bread doughs may produce a superior final baked product, the additional time and inconvenience required by yeast-leavened refrigerated bread doughs limit their appeal to consumers.

Attempts have been made to utilize yeast in leavening a refrigeratable dough. However, yeast is problematic in these types of doughs in that its leavening action is not readily controlled. Whereas the total volume of carbon dioxide generated by chemical leavening agents can be very accurately and reproducibly controlled by controlling the quantity of the leavening agent in the dough composition, such control is not found with yeast strains known in the art. This is primarily due to the fact that yeast is a living organism and will continue to generate carbon dioxide at refrigeration temperatures.

Commercially produced refrigeratable doughs are sold in substantially air-tight containers. The carbon dioxide generated during the proofing process generally builds a pressure within the container of about 15–20 psi. If the pressure within these containers substantially exceeds that pressure, the containers will rupture. Accordingly, yeast-leavened doughs cannot be sold in these containers because their shelf life would be much too short for an acceptable commercial product—these packaged doughs would explode well before the end of current doughs' shelf life. Furthermore, even if one were to package the yeast in a much more expensive container, such as a hermetically sealed metal can, when the consumer opens the can the sudden release of substantial internal pressure could damage the dough or cream other problems.

A number of attempts have been made to adjust the formulation of a yeast-leavened dough to limit the fermentation activity of the yeast. For instance in U.S. patent application Ser. No. 732,081 (filed Jul. 18, 1991), now abandoned, which is owned by the assignee of the present invention and incorporated herein by reference, the yeast used in the dough composition is adapted to substantially cease fermentation at refrigeration temperatures.

Yeast proofs dough better in aerobic atmospheres than it does in anaerobic atmospheres. Nonetheless, yeast will continue to proof dough under anaerobic conditions, albeit generally at a lower rate. In commercially packaging doughs, a head space generally must be left within the container so that the doughs will have room to rise within the container during the manufacturing and packaging process. The head space generally comprises air and the yeast will tend to consume the oxygen in that air relatively rapidly. However, when the oxygen within the head space has been consumed by the dough, the yeast simply starts to ferment under anaerobic conditions and continues to generate carbon dioxide. As explained above, the continuing build-up of carbon dioxide will eventually cause the container to rupture.

Another problem encountered with refrigeratable bread doughs is that they tend to "gray" in the presence of oxygen. When oxygen comes into contact with the dough during refrigeration, it will tend to oxidize certain components in the outermost layers of the dough. These reactions cause the outer skin of the dough to turn a rather unappealing gray color, which consumers generally find unacceptable. Thus, commercially-produced refrigeratable bread doughs must be packaged in substantially gas-impermeable containers to prevent the dough from coming into contact with oxygen. As noted above, such containers would prevent the use of yeast to leaven the dough because the containers would tend to rapture.

Substantial research and development has gone into attempts to provide a commercially salable yeast-leavened dough which may be refrigerated for extended periods of time. Despite all of this concerted effort in the industry, though, there are no commercially-produced doughs which are leavened with yeast yet may be stored for extended periods of time at refrigeration temperatures.

SUMMARY OF THE INVENTION

The present invention provides a container for refrigeratable bread doughs which comprises a wall defining an interior cavity of the container and a pressure control means forming a pan of the wall. The wall may have a port therethrough, with the pressure control means being sealingly attached to the port.

In one embodiment, the pressure control means is a membrane which is selectively permeable and transmits carbon dioxide relatively freely while restricting passage of oxygen into the interior cavity. In a preferred embodiment, the membrane's ratio of the carbon dioxide transmission rate to the oxygen transmission rate is no less than about 6:1. The membrane is also desirably adapted to limit the ingress of oxygen into the container's inner cavity to no more than about 1.7–2.0 cc/day/200 grams of dough. The membrane's oxygen permeability should be selected to limit the steady-state concentration of oxygen in the headspace of the container to no more than about one percent of the total gas volume.

In another embodiment, the pressure control means of the container comprises a one-way valve responsive to the pressure within the container. This valve is adapted to vent excess pressure from carbon dioxide to the atmosphere without admitting any appreciable amount of oxygen into the container. The valve means is desirably so positioned on a dough container to limit contact between the dough and the valve means.

The present invention also provides a refrigeratable dough product comprising a container such as that set forth above having a yeast-leavened dough therein. The pressure within the inner cavity of the container is maintained at no more than about 5 psi, with a pressure of no more than about 3 psi being preferred.

DETAILED DESCRIPTION OF THE PREFERRED EMBODIMENTS

Figure 1:
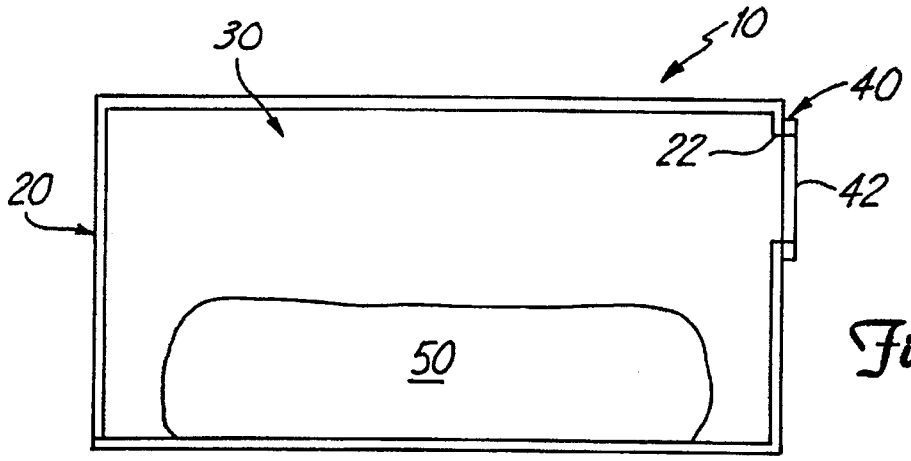
FIG. 1 is a schematic drawing illustrating a refrigeratable dough product according to the invention.

FIG. 1 schematically depicts a container and a refrigeratable dough product of the invention. Generally, the invention comprises a container (10) having a wall (20) which encloses and generally defines an interior cavity (30). The wall (20) includes a pressure control means (40) for controlling the internal pressure of the container. A yeast-leavened dough is positioned within the inner cavity (30). This dough product is adapted for extended storage at refrigeration temperatures. This represents a significant advance in the art in that no refrigeratable yeast-leavened dough product is commercially available at this time.

The wall may be of virtually of any desired construction. If so desired, the walls may be relatively rigid. In a preferred embodiment, though, the wall (20) will be formed of a flexible polymeric material. In one preferred embodiment, the polymeric material be laminated with a metal foil or the like to substantially eliminate gas permeability. Alternatively, the wall may be somewhat permeable to both oxygen and carbon dioxide, such as where the wall is formed of a polypropylene film or the like.

In packaging dough in accordance with the present invention, the dough will commonly be placed within the package in a substantially unproofed state and the wall will be sealed with the dough contained therein. As explained below, one may flush the headspace with an anaerobic gas-such as nitrogen to substantially eliminate oxygen from the headspace prior to sealing the wall. A polymeric material may be used to form a surface of the wall, thereby allowing the wall to be closed by heat sealing or other means known in the art.

The pressure control means used in the present invention limits the ingress of oxygen into the inner cavity while permitting carbon dioxide to egress. Currently, two different embodiments of such a pressure control means are contemplated. In the first of these two embodiments, the pressure control means comprises a selectively permeable membrane while in the other embodiment the pressure control means comprises a pressure-sensitive valve.

In the first embodiment, the pressure control means (40) comprises a membrane formed of a selectively permeable polymeric material. The membrane forms at least a portion of the wall (20) and is adapted to transmit carbon dioxide at a significantly higher rate than oxygen. This will permit the carbon dioxide generated by the yeast to be vented to the atmosphere while limiting the mount of oxygen that comes into contact with the dough. For reasons explained more fully below, it is preferred that the ratio of carbon dioxide transmittance to the transmittance of oxygen by this membrane be at least about 6:1, with a ratio of at least about 8:1 being preferred.

In the schematic drawing of FIG. 1, the wall also includes a port (22) which passes therethrough. This permits the inner cavity (30) to communicate with the exterior atmosphere so that carbon dioxide may be vented to the atmosphere. This will prevent a buildup of pressure within the container, which could lead to rupture of the wall. If one were to simply flow a port to remain open, the dough could become contaminated. Additionally, leaving a port in the wall open would permit oxygen to enter the inner cavity (30) just as easily as carbon dioxide could leave the cavity. As explained above, excessive levels of oxygen in contact with refrigerated dough can cause the dough to gray.

Depending on the particular dough product, the membrane may form a relatively small portion of the total surface area of the wall (as illustrated in FIG. 1) or it may constitute most, if not all, of the wall. In an embodiment employing a port (22) covered by a patch (42), the patch should be sealingly attached to the wall to sealingly cover the port (22) form therein. This may be accomplished by heat sealing the patch about the periphery of the port if the patch and/or the material of the wall (20) is formed of a heat sealable material. If not, a suitable, substantially gas-impermeable adhesive or the like may be used, with the adhesive being disposed about the edge of the patch to provide a substantially impermeable seal between the periphery of the patch and the edge of the port in the wall.

In another version, the patch is provided with a substantially gas-impermeable adhesive printed on one side thereof in a series of small "dots". This patch may be placed over the port and the adhesive between the patch and the wall will provide a strong, generally gas-impermeable seal between these two elements about the periphery of the patch. The portion of the patch disposed over the port will remain permeable over the surface area which is not covered by the adhesive, providing a suitable selectively permeable membrane covering the port.

The relative sizes of the port and the patch will depend upon the materials used in their construction and the volume of carbon dioxide which must exit the container to prevent rupture, which is in turn determined at least in part by the quantity of dough (50) within the inner cavity and the concentration of yeast within that dough. It has been found that the combined transmission rate of oxygen through the wall (20) and the patch (42) should be no more than about 1.7 cc of oxygen/day/200 g of dough, while the wall and the patch should permit carbon dioxide to exit the package at a rate of at least about 9.6 cc of carbon dioxide/day/200 g of dough. This yields a minimum ratio of carbon dioxide transmittance to oxygen transmittance of at least about 5.6.1.

It has been determined that the concentration of oxygen in the head space (32) of the inner cavity is critical in the process of graying of the dough, if the concentration of oxygen in this head space is sustained at a level of more than about 1%, the dough will turn an unattractive gray color. Accordingly, it is important to limit the concentration of oxygen in this head space to a level below about 1%. The initial concentration of oxygen in this head space may be varied within a rather broad range because the yeast within the dough will consume the oxygen over a period of time. It is believed that the initial concentration of oxygen in the headspace is not an important factor in the overall effectiveness of the container (10) because most of the oxygen in the headspace can be consumed within a few days. If so desired, though, this headspace may be initially flushed of oxygen with an anaerobic gas such as nitrogen to reduce the initial level of oxygen in the container.

It is believed that the rate of transmission of oxygen into the cavity is the limiting factor in designing the container (10); the dough's capacity to consume oxygen is not unlimited. The ability of a dough to effectively utilize oxygen will depend to a significant extent upon the concentration of yeast in the dough, the activity of the strain of yeast used, and other factors relating to the particular composition of the yeast.

In testing one exemplary dough composition, (containing about 1785 g (58.5 wt. % wheat flour, 960 g (32 wt. %) water, 105 g (3.5 wt. %) dextrose, 75 g (2.5 wt. %) soy oil, 45 g (1.5 wt. %) salt, and 30 g (1 wt. %) yeast), it was found that the dough could consume only about 2 cc/day/200 g of dough. Hence, if one were to permit oxygen to enter the head space (32) at a rate higher than about 2 cc/day/200 g of dough, the dough would not consume enough of that oxygen to prevent the partial pressure of oxygen in the head space from increasing beyond the 1% threshold and the dough would tend to gray. If oxygen is transmitted at the same rate or at a lesser rate, though, the yeast should be able to consume substantially all of the oxygen and the oxygen level in the head space may be maintained at a sufficiently low level.

The rate at which carbon dioxide is permitted to exit the head space through the patch (42) should obviously be sufficient to prevent the pressure within the inner cavity (30) from building to a level which will cause the container to rupture. For a container having a wall (20) formed of a polymeric film which has been conventionally heat-sealed, it has been found that the seal will tend to rupture if the internal pressure exceeds about 3–6 psi. Accordingly, the carbon dioxide must be permitted to exit the container at a rate to maintain the pressure over the expected shelf life of the packaged dough product below that critical level.

In order to prevent the container from rupturing, it has been found that the wall (20) and the patch (42) should transmit carbon dioxide at a total rate of at least about 9.6 cc/day/200 g of dough. The transmission rate may be significantly higher than that minimum; for example, a transmission rate of about 20 cc/day/200 g should work well.

In theory, as the partial pressure of carbon dioxide in the head space increases, the concentration of carbon dioxide dissolved in the dough will increase, yielding a better leavened product. In practice, though, it has been found that particularly high partial pressures of carbon dioxide (e.g. 3 psig or more) surrounding a dough will tend to yield a final baked product with a reduced specific volume. For containers maintained at relatively low pressures, such as those envisioned in one embodiment of the present invention, a suitable dough will be obtained even if the rate of carbon dioxide transmission exceeds the rate at which the dough generates the gas.

A variety of membrane materials which are currently available on the market meet the demands of the present invention. One membrane material which has been found to be suitable in the present application is sold by Borden Packaging and Industrial Products as a "resinite produce film" under the designation VF-71. This membrane material has been found to transmit carbon dioxide and oxygen at a ratio of about 11,450:1400, or about 8.2:1. Another suitable film made by Borden Packaging and Industrial Products is sold under the designation MSN-86 and exhibits a ratio of carbon dioxide transmission to oxygen transmission of about 7.35:1.

The relative surface areas of the "patch" (42) and the rest of the wall (20) will depend on a number of factors. The goal of balancing the surface areas is to provide a container which will transmit no more than about 1.7 cc $O_2$/day/200 grams of dough and transmit carbon dioxide at a rate of at least about 9.6 cc/day/200 grams of dough. In selecting relative surface areas of the patch and the rest of the wall, it is also advantageous to minimize the cost of the container (10) by using the least expensive combination of materials.

In a conceptually relatively simple embodiment, the wall (20) is formed of a substantially gas-impermeable material. For instance, this material may be a laminated polymeric film. Alternatively, the dough (50) may be placed within a tray formed of a substantially gas-impermeable material and the open top of the tray, which may be defined as the port (22), is sealingly covered with a selectively permeably membrane. (An invention having a similar structure is described below in connection with FIGS. 2 and 3, which relate to another embodiment of the present invention. An invention of the present embodiment may be provided by replacing the vent (42') and top wall (25) of FIGS. 2 and 2 with a top wall of a selectively permeable membrane material.)

In an embodiment wherein the material used to form the wall (20) is substantially gas-impermeable, the transmittance of oxygen and carbon dioxide are determined solely by the patch (42). The transmittance of this patch will depend on the transmittance of the membrane forming the patch and the surface area of the patch. The size of the patch and the patch's transmittance should be sufficient to allow no more than about 1.7 cc $O_2$/day/200 grams of dough to enter the container while permitting at least about 9.6 cc $CO_2$/day/200 grams of dough to exit the container. This means that the membrane used to form the patch should have a ratio of carbon dioxide transmittance to oxygen transmittance of at least about 5.6:1, although significantly greater ratios should also work.

As a matter of fact, it would be advantageous to use a film which has a ratio of $CO_2$:$O_2$ transmittance of 6:1 or more. This will permit the surface area and material of the patch to be selected to limit the amount of oxygen entering the container to no more than about 1.7 cc day/200 grams of dough, yet allow carbon dioxide to escape the container at a rate equal to or greater than about 10 cc day/200 grams of dough. As the $CO_2$:$O_2$ transmission ratio is increased, the greater the safety factors for these relative minimum and maximum transmittances can be increased.

It should be evident that the surface area of the patch will depend a great deal upon the net transmittance of the membrane used in forming the patch and the mount of dough placed in the container. However, selecting the relative surface areas of the wall and the patch in such a container is a rather straightforward calculation in that the entire transmittance needs of the container are to be provided by the patch (42). As noted above, though, the rest of the wall need not be formed of a gas-impermeable material but may instead be made of polymeric materials which may transmit gas at an appreciable rate, such as polyethylene or the like. Since the patch (42) will not be the only portion of the container transmitting gas, one will have to take the transmittance of the rest of the wall (20) into consideration in determining the net transmittance of the container.

Although using a somewhat gas-permeable membrane for the wall (20) may somewhat complicate the calculations in determining the relative surface areas of the patch and the wall, this calculation is well within the abilities of one of ordinary skill in the art. It is important to note that the transmittance of the wall (20) should be taken into account in determining the relative surface areas of the wall and the patch. If the wall is made of a material which transmits carbon dioxide and oxygen at about the same rates, or even transmits oxygen at a higher rate than carbon dioxide, the net transmittance of the wall must be balanced by the transmittance of the membrane forming the patch. It would be desirable to use a membrane which has a $CO_2$:$O_2$ transmittance ratio of greater than 5.6:1, and desirably as high as about 8:1 or greater, in order to provide the overall container (10) with the desired transmittance ratio and rates while minimizing the size of the patch.

In some instances, it may be necessary to make the patch very large as compared to the rest of the wall. As noted above, in an extreme circumstance, it may be necessary to form the entire wall (20) of the container of the selectively permeable membrane material. This endpoint of the sliding scale of relative surface areas of the patch and the rest of the wall may occur, for example, where there is a relatively large volume of dough within a container having a relatively small surface area. In one version of embodiment, the container is shaped substantially the same as the container shown in FIGS. 2 and 3 (and discussed immediately below). Rather than using a vent (40'), the top wall (25) may be formed of a selectively premeable membrane in accordance with the present embodiment of the invention and the entire top wall (25) would serve as would serve as the pressure control means (40) of the container.

As noted above and illustrated in FIGS. 2 and 3, in an alternative embodiment of the invention the pressure control means (40) comprises a pressure-sensitive valve (40') rather than a selectively permeable membrane. The pressure-sensitive valve should be adapted to release pressure built up within the inner cavity (30) by venting gas to the atmosphere before the internal pressure reaches a critical level. As noted above, this critical level is believed to be between about 3 and 6 psi for packages formed by conventional means, such as heat sealing, from most polymeric films. It may also be desirable to release the pressure at a lower level because many packages will tend to "balloon" before they would fail. Using a valve (40') with a lower release pressure would limit or prevent such unattractive ballooning.

A wide variety of pressure-sensitive valves of varying sizes and types are available on the market. It is preferred, however, that valves used in the present invention be "one-way" valves. Such a valve may be disposed in a port (44) formed in the wall (20) of the container and permit gas to escape when the relative internal pressure of the container exceeds a specified level, but it will not permit air or other gases to enter the container, even when venting excess internal pressure. Such one-way valves are known in the art and need not be discussed in detail here.

Pressure-sensitive one-way valves are known in the art and are used in packaging for food products such as coffee beans. However, products such as coffee beans consist of discrete, relatively large units which do not interfere with the operation of a valve. Dough products, on the other hand, will tend to clog such valves and render them inoperative, or at least greatly reduce their efficacy. When used in a container of the invention, though, it has been found that one-way valves can work quite effectively.

Such one-way valves (42') generally comprise an inlet, an outlet and a pressure-responsive valve (not shown). This valve will open when a minimum pressure on the inlet side of the valve has been reached and will vent the pressure until the minimum threshold is again reached, at which time the valve will close again.

The threshold pressure of a valve of the invention may fall within a wide range, but the threshold pressure should be less than the anticipated maximum internal pressure of the container, e.g. 3–6 psig. In one embodiment which has worked well, the valve (42') opens when the internal pressure of the container is about 0.07–0.22 psig. It has also been determined that the specific volume of a final baked product generally correlates inversely to the pressure within the container over the range of about 0–3 psig. Accordingly, using a valve which vents carbon dioxide at a lower pressure, e.g. less than 1 psig, will result in a superior baked product.

In order to test the efficacy of a container of the invention employing a one-way valve, a dough composition was prepared and placed in containers of the invention using several different one-way valves. The formulation of the dough used in these experiments was approximately as follows: 62.0 weight percent (wt. %) high gluten untreated wheat flour, 30.3 wt. % water, 3.5 wt. % dextrose, 2.5 wt. % soybean oil, 1.0 wt. % salt, and 0.7 wt. % instant dry yeast. All of the dry ingredients in this formula were charged in a Hobart mixing bowl with a model C-1001 mixer at low speed for one minute with a dough hook. The soybean oil and water were then added and the resulting mixture was mixed at low speed for an additional minute. The dough was finally mixed for a final five minutes at a higher speed.

Ports (22) were formed in the walls of three 850 $cm^3$ bags having walls (20) formed of polypropylene. The port was formed by simply cutting out a surface area sufficient for receiving a one-way valve. A different one-way valve (42') was sealingly attached to the port of each-of these bags, such as by heat sealing or the like. These three different valves were as follows:

1. A Goglio valve marketed by Fresco, Inc. and made by Goglio Luigi Milano S. D. A. of Italy. The manufacturer specified that this valve will vent carbon dioxide at a pressure of about 0.15–0.22 psig.
2. An SIC valve marketed by Raymond Automation Company, Inc., a subsidiary of Switzerland Industrial Group (SIC) Packaging Technology Division. This SIG valve was rated by the manufacturer as releasing carbon dioxide at a pressure range of about 0.07–0.15 psig (5–10 mbar).
3. A valve sold under the name of "Aromafin" by the Robert Bosch Corporation, Packaging Machinery Division. Bosch rates the release pressure of these valves at 0.07–0.15 psig (5–10 mbar).

A 200 g sample of the dough set forth above was placed in each of these three containers. The containers were then heat sealed and stored at 40° F. Of these three different containers, two of the valves performed well while the third did not. In particular, the Goglio valve and the SIG valve both withstood the refrigeration temperatures. Both of these valves minimized pressure built-up in the inner cavity (30) and maintained the structural integrity of the container. The samples in these two containers did not exhibit any graying.

The Bosch one-way valve did not perform acceptably. This valve opened to release pressure which had built up within the inner cavity (30), but it did not reseal itself. This permitted oxygen to enter the head space of the container and the concentration of oxygen in the head space increased to about 7–14% by the end of 10 days of storage under refrigeration conditions. The high oxygen content in the head space caused the dough to turn grey, yielding an unacceptable product.

A container (10) according to the present embodiment can take any desired shape. It is important, though, to place the valve (42') at a location disposed away from contact with the dough (50). As explained above, if the dough is in direct physical contact with the valve, the valve could fail because the dough may clog the valve and prevent it from operating in its intended fashion.

The container may, for instance, take the form of a heat-sealed bag formed of a polymeric film material. The valve should be placed along the wall (20) of the container at a location which will normally remain disposed away from the dough. For example, if such a bag were made with an ordinary orientation wherein the dough rests in the "bottom" of the bag, the valve should be positioned on an "upper" portion of the bag, i.e., toward the "top" of the bag when it is in its ordinary position. This configuration can present a problem, though, if the container were to be inadvertently inverted during shipping, handling or storage. This would place the dough into direct physical contact with the valve and could prevent the valve from venting excess pressure within the container. If the bag were inverted for a significant period of time, this would cause unacceptable pressures to build within the container.

Figure 2:
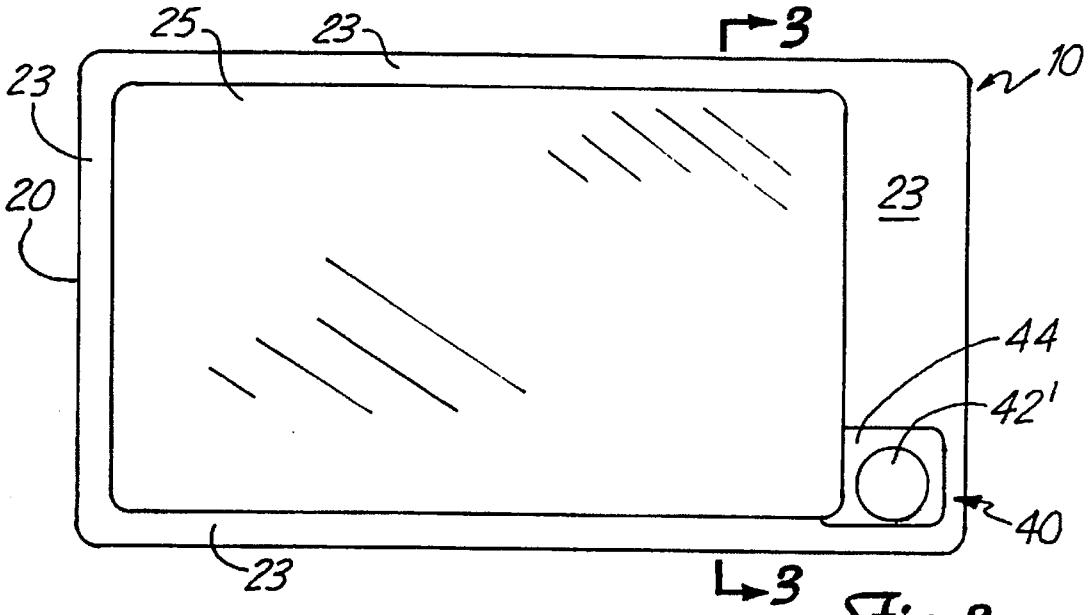
FIG. 2 is a top elevational view of an embodiment of the invention utilizing a vent means.
Figure 3:
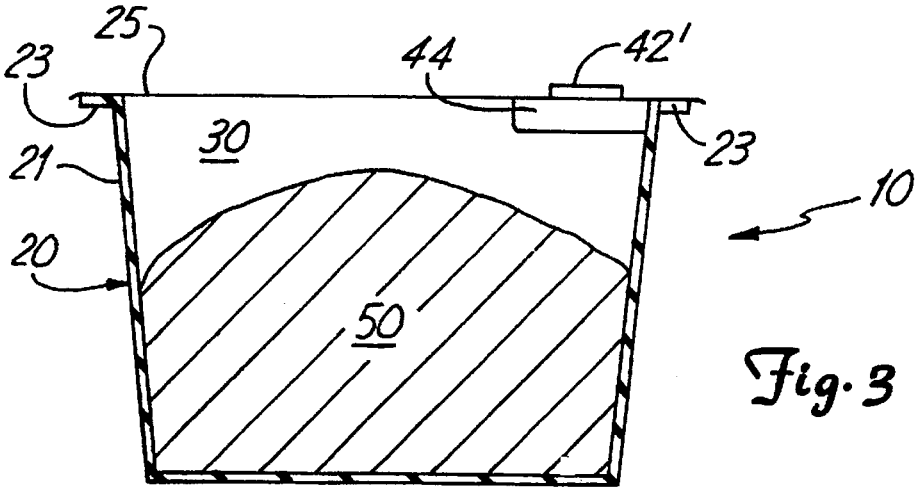
FIG. 3 is an end cross-sectional view of the invention taken along line 3—3 of FIG. 2.

Accordingly, in a particularly preferred embodiment, contact between the dough and the valve is limited by structural impediments. FIGS. 2 and 3 illustrate one configuration of the container (10) which utilizes such a structural impediment. In these figures, the container (10) includes a wall (20) generally defining the inner cavity (30) of the container. If so desired, the entire wall (20) may be made of a single piece of the same material. In the embodiment shown in these drawings, though, the majority of the wall (20) is formed of a relatively rigid, substantially gas-impermeable material which defines a tray (21) within which the dough (50) is placed.

In one particularly useful embodiment, this tray is formed of material within which the dough may be baked. Although the tray (21) may be formed of metal or the like, it is also contemplated that the tray could be formed of any of a wide variety of materials, such as paper/polymer composites, which are capable of withstanding oven temperatures ordinarily encountered in baking dough products. If a "microwaveable" dough is intended to be sold in a container of the invention, the material used to form this tray (21) obviously should be safe for use in a microwave oven.

In the embodiment shown in FIGS. 2 and 3, the tray (21) is covered with a polymeric film. In order to ensure that the concentration of oxygen in the head space (30) remains at an acceptable level, the polymeric film forming the top wall (25) should be selected to allow no more than about 1.7 $ccO_2$/day/200 grams of dough, and desirably admits significantly less oxygen into the inner cavity (30). A top wall. (25) formed of barrier polyethylene terephthalate (PET) lidstock, e.g., Du Pont's 50 OL 4–8 g. Mylar™ brand PET/heat seal layer, should provide a suitable material for the top wall.

The top wall (25) should be sealingly attached to the tray (21). In the embodiment shown in FIGS. 2 and 3, the tray (21) includes a flange (23) extending about its periphery. The top wall (25), if formed of a suitable material, may simply be heat-sealed to the flange (23) to provide a relatively strong, substantially gas-fight seal between these two elements of the wall (20). Packages of this general construction are known in the art for use in connection with frozen prepared foods and the like. Virtually any materials or methods which are known to be useful in forming those kinds of containers may also be used in forming the container (10) of the present invention.

As explained above, containers (10) of the present invention also include a pressure control means (40). In the present embodiment, this pressure control means includes a pressure-responsive valve (42'), which is desirably a one-way valve which vents excess internal pressure to the atmosphere. This valve (42') may be disposed virtually anywhere along any wall of the tray, with an upper potion of the wall (20) of the container.

Optimally, though, the valve (42') is disposed away from the center of the top wall (25) and instead be placed adjacent a side wall of the tray (21). As dough tends to rise within the inner cavity of the container, friction between the dough and the tray (21) will tend to cause the dough to rise a little more rapidly in the center than it will at the edges in contact with the tray (21), as illustrated in FIG. 3. Providing at least enough head space for the dough to rise within the container without contacting the top wall (25) will prevent the dough from coming into contact with the valve (42'), particularly if the valve is disposed away from the center of the top wall (25); the dough will tend to contact the center of the top wall before it would engage the area of that wall adjacent the flange (23) of the tray.

FIGS. 2 and 3 depict a particularly preferred embodiment which utilizes a means for impeding contact between the dough and the valve (42'). In the illustrated embodiment, a portion of the flange (23) at the upper periphery of the tray (21) is made somewhat wider than may ordinarily be necessary to provide a suitable seal between the tray and the top wall (25). This wider portion of the flange (23) is provided with a recess (14) which is adapted to be in gas communication with the rest of the inner cavity (30) of the container. The valve (42') is sealingly attached to a port (not shown) in the top wall (25) at a position disposed over this recess. Alternatively, the port could be in the wall forming the flange (23); the valve and port should just be in gas communication with the inner cavity (30). The recess (44) thus serves effectively as a gas conduit between the valve (42') and the interior cavity of the container.

As noted above, the dough will tend to cling to the wall of the tray (21) as it rises. By positioning the recess (44) adjacent an upper edge of the tray, the chance of having any dough enter the recess and block the flow of gas from the head space to the vent is quite low. As a matter of fact, this is likely to occur only when the dough rises to completely fill the inner cavity of the container and is essentially extruded into the recess (44).

In the embodiment shown in FIGS. 2 and 3, the shape of the recess (44) is relatively simple, providing a fairly direct path from the location of the valve (42') to the inner cavity of the container. If so desired, though, the shape of this recess may be made somewhat more complex to further reduce the chances that the dough (50) will come into contact with the valve. Since gas can obviously pass along a complex channel more readily than dough, one could, for instance, form the recess into a serpentine configuration (not shown) which includes a plurality of turns. The pressure control means (40) would still work in substantially the same fashion, but it would be virtually impossible for the dough to come into direct physical contact with the valve.

As noted above, a wide variety of materials and techniques are available for making trays (21) which meet the parameters set forth above. The inclusion of a recess in the present embodiment, though, may make some forming techniques easier than others. For instance, it may be easier to form the tray (21) of a plastic material by means of injection molding or the like rather than attempting to fold the container into the desired configuration when using a paper or paper composite material for the tray.

A dough product according to this embodiment of the invention may be stored for extended periods of time at refrigeration temperatures. The vent (42') will permit any excess pressure which may build within the container to be vented to the atmosphere. When a consumer purchases the dough product and desires to bake the dough, the top wall (25) can be removed from the tray (21). Since the valve (42') is attached to the top wall, when the top wall is removed the valve will generally also be removed. The tray and the dough may then be placed into the oven and the dough may be baked within the tray.

The present invention also contemplates a refrigeratable dough product utilizing a container of the present invention. The dough product generally comprises a container such as that of one of the two embodiments set forth above having a yeast-leavened dough therein. Such a refrigeratable dough product may be formed by having a wall (20) with a port (22) and an opening (not shown) therein for allowing the dough to be placed within the container. A pressure control means, which may be a patch comprising a selectively impermeable membrane or a pressure-responsive valve, is sealingly attached to the port (22); the patch or the one-way valve may be substantially as set forth above.

In forming a refrigeratable dough product of the invention, a predetermined quantity of a dough containing yeast will be placed within the inner cavity (30) of the container and the opening in the wall will be sealed. This sealing may be accomplished by heat sealing or any other means suitable for the material of the wall. The volume of the dough and of the inner cavity (30) should be chosen so that the head space left in the inner cavity is sufficiently large to accommodate expansion of the dough as it proofs. Particularly in the embodiment utilizing the membrane, it may be desirable to allow additional headspace-to remain to prevent the dough from interfering with operation of the pressure control means.

If so desired, the head space may be filled with ambient air which remains within the inner cavity when the container is sealed. Alternatively, one may flush the inner cavity with an anaerobic gas such as nitrogen to remove a substantial potion of the oxygen within the head space. Obviously, this flushing should be done prior to the sealing of the opening in the side wall.

In order to avoid rupturing the side wall (20) of the invention, the internal pressure within the container (10) should be maintained at a level below the rupture strength of the wall or of its connection to other structural elements of the container. As noted above, this rupture strength will vary depending upon the material used in forming the walls and the manner in which the container is sealed, but for most polymeric films the internal pressure must be no more than about 6 psi, and desirably less than about 3 psi. As further explained above, the specific volume of the dough depends upon the internal pressure of the container. Accordingly, in a preferred embodiment, the internal pressure within the container is no more than about 2–3 psig and is preferably close to about 0 psig.

While a preferred embodiment of the present invention has been described, it should be understood that various changes, adaptations and modifications may be made therein without departing from the spirit of the invention and the scope of the appended claims.

What is claimed is:

1. A method for packaging a refrigeratable dough product, said method comprising the steps of:

providing a package comprising a substantially gas-impermeable tray defining an interior cavity, the tray comprising a flange portion positioned on an upper edge of the tray and extending around its periphery, said flange including a recess that is positioned within the flange but which does not extend to an outer perimeter of the flange; a top wall; a port formed through the top wall above the recess; and a pressure control means sealingly attached to the port; said port being in gaseous communication with said interior cavity via said recess and through said pressure control means;

placing an expandable yeast leavened refrigerated dough within the interior cavity of said tray;

sealing the package containing the dough by sealingly attaching the top wall to the tray to cover the dough containing interior cavity and the recess, said recess being positioned in said flange together with said dough being positioned in said interior cavity such that enough head space is provided above the dough such that the dough will rise without the dough substantially interfering with said gaseous communication between the interior cavity and the port even as the dough expands to fill the inner cavity;

wherein the pressure control means is capable of venting dough generated carbon dioxide from the package and maintaining an internal equilibrium pressure of less than about 6 psig within the tray during refrigerated storage and as the dough expands within the package, such that pressure is prevented from building to a level which will cause the package to rupture, said pressure control means also substantially preventing the ingress of air into the package.

2. The method of claim 1, wherein the pressure control means is a pressure-responsive one-way valve adapted to release carbon dioxide from the interior cavity of the tray and limit the ingress of oxygen into the interior cavity.

3. The method of claim 2, wherein the valve is capable of maintaining an internal pressure of between about 3 psig and 6 psig.

4. The method of claim 2, wherein the valve is capable of maintaining an internal pressure of less than about 3 psig.

5. The method of claim 1, wherein the interior cavity of the package containing the dough is flushed with a gas prior to sealing the package.

6. The method of claim 1, wherein the package containing the dough is stored at refrigeration temperatures after the package is sealed.

* * * * *

UNITED STATES PATENT AND TRADEMARK OFFICE

CERTIFICATE OF CORRECTION

PATENT NO. : 5,643,625

DATED : July 1, 1997

INVENTOR(S) : Michael R. Perry, et al.

It is certified that error appears in the above-indentified patent and that said Letters Patent is hereby corrected as shown below:

Column 1, line 25, "leavering" should read --leavening--.

Column 1, line 28, "quantifies" should read --quantities--.

Column 2, line 11, "cream" should read --create--.

Column 2, line 62, "pan" should read --part--.

Column 4, line 15, "mount" should read --amount--.

Column 4, line 27, "flow" should read --allow--.

Column 5, line 3, "5.6.1" should read --5.6:1--.

Column 7, line 45, the second occurance of "would serve as" should be deleted.

Column 8, line 56, "SIC" should read --SIG--.

Column 8, line 58, "SIC" should read --SIG--.

UNITED STATES PATENT AND TRADEMARK OFFICE

CERTIFICATE OF CORRECTION

PATENT NO. : 5,643,625

DATED : July 1, 1997

INVENTOR(S) : Michael R. Perry, et al.

It is certified that error appears in the above-indentified patent and that said Letters Patent is hereby corrected as shown below:

Column 10, line 1, delete the period (.) after the word "wall".

Column 10, line 10, "fight" should read --tight--.

Column 10, line 46, "14" should read --44--.

Column 11, line 51, delete the hyphen (-) after the word "headspace".

Column 11, line 58, "potion" should read --portion--.

Signed and Sealed this

Sixth Day of January, 1998

*Attest:*

*Attesting Officer*

Bruce Lehman

BRUCE LEHMAN

*Commissioner of Patents and Trademarks*